US008308900B2

(12) United States Patent
Covarrubias et al.

(10) Patent No.: US 8,308,900 B2
(45) Date of Patent: Nov. 13, 2012

(54) METHODS TO CONTROL LIPOPHILIC EXTRACTIVES IN ACACIA WOOD PULP AND FIBER

(75) Inventors: Rosa M. Covarrubias, Memphis, TN (US); Budi Liputra, Jakarta Barat (ID)

(73) Assignee: Buckman Laboratories International, Inc., Memphis, TN (US)

( * ) Notice: Subject to any disclaimer, the term of this patent is extended or adjusted under 35 U.S.C. 154(b) by 861 days.

(21) Appl. No.: 11/853,859

(22) Filed: Sep. 12, 2007

(65) Prior Publication Data

US 2008/0066879 A1 Mar. 20, 2008

Related U.S. Application Data

(60) Provisional application No. 60/844,745, filed on Sep. 15, 2006.

(51) Int. Cl.
*D21C 3/22* (2006.01)

(52) U.S. Cl. ..... 162/70; 162/72; 162/158; 435/278

(58) Field of Classification Search ..... None
See application file for complete search history.

(56) References Cited

U.S. PATENT DOCUMENTS

| | | | | |
|---|---|---|---|---|
| 4,643,800 | A | 2/1987 | Maloney et al. | |
| 5,256,252 | A | 10/1993 | Sarkar et al. | |
| 5,356,800 | A | 10/1994 | Jaquess | |
| 5,507,952 | A | 4/1996 | Jaquess et al. | |
| 5,575,993 | A | 11/1996 | Ward et al. | |
| 5,681,862 | A | 10/1997 | Hollis et al. | |
| 5,780,283 | A | 7/1998 | Lee | |
| 6,471,826 | B2 | 10/2002 | Glover et al. | |
| 6,677,427 | B1 * | 1/2004 | Cheng et al. | 528/310 |
| 6,991,707 | B2 | 1/2006 | Hill, Jr. et al. | |
| 2003/0124710 | A1 * | 7/2003 | Borch et al. | 435/262 |
| 2004/0163782 | A1 | 8/2004 | Hernandez-Munoa et al. | |
| 2006/0089283 | A1 | 4/2006 | Glad et al. | |

FOREIGN PATENT DOCUMENTS

| | | | |
|---|---|---|---|
| EP | 1 376 222 | A1 | 1/2004 |
| EP | 1 676 956 | A2 | 7/2006 |
| WO | WO 2005/106110 | A1 | 11/2005 |
| WO | WO 2007/091216 | A1 | 8/2007 |

OTHER PUBLICATIONS

International Search Report and Written Opinion for PCT/US2007/020051 dated Jan. 17, 2008.

Ginting et al., "*Acacia—The Fibre of Choice*," Tissue World Asia (Shanghai, China), Nov. 16, 2006, seven pages.

"*Resinase® A 2X*," Product Sheet, Forest Products/2001-07747-02.pdf., Novozymes A/S, May 2001, three pages.

"*Resinase® HT*," Product Sheet, Forest Products/2003-21962-01.pdf., Novozymes A/S, Jul. 2003, three pages.

* cited by examiner

*Primary Examiner* — Matthew Daniels
*Assistant Examiner* — Jacob Thomas Minskey
(74) *Attorney, Agent, or Firm* — Kilyk & Bowersox, P.L.L.C.

(57) ABSTRACT

Methods to control lipophilic extractives in *Acacia* pulp and fibers are described. One method involves contacting the pulp or fibers with a composition containing at least one enzyme, such as at least one esterase or lipase or both, for a sufficient time and in a sufficient amount to control the lipophilic extractives present in the pulp or fibers.

18 Claims, 1 Drawing Sheet

METHODS TO CONTROL LIPOPHILIC EXTRACTIVES IN ACACIA WOOD PULP AND FIBER

Figure 1A:
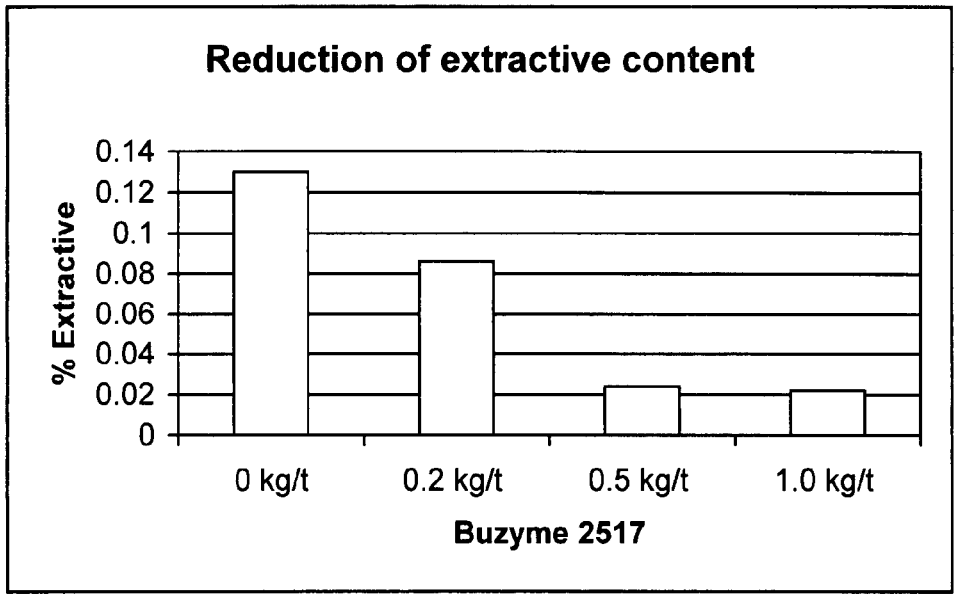

This application claims the benefit under 35 U.S.C. §119 (e) of prior U.S. Provisional Patent Application No. 60/844,745, filed Sep. 15, 2006, which is incorporated in its entirety by reference herein.

BACKGROUND OF THE INVENTION

The present invention relates to paper making processes and more particularly relates to controlling lipophilic extractives present in *Acacia* fibers used to make paper or fiber containing products (e.g., tissue).

Lipophilic material, including waxes, on machine surfaces, fabrics, wires, felts, and rolls can lead to problems, such as wet end breaks, pressroom breaks, dryer section breaks, holes, sheet defects, and high dirt counts. These deposits and associated problems can lead to a significant amount of downtime yearly.

Various sources of wood are used for pulp in order to make paper and other wood-based products. As sources for pulp begin to dwindle, alternative wood sources are being considered. However, when alternative wood sources are considered and/or used, the pulp may be less desirable from these alternative wood sources due to components that are present with the wood pulp, such as wax, pitch, and the like. For instance, mixed hardwood, *Eucalyptus*, Aspen, Birch, and other similar pulp fibers are used to make different grades of paper. However, the availability of pulp fibers from the *Eucalyptus* wood have recently been affected by restrictions with respect to harvesting and the like. More particularly, some *Eucalyptus* wood is recovered from plantations, and there is great concern on the over-harvesting of *Eucalyptus* from these plantations. In addition, recently, the use of MTHW (mixed tropical hardwood) pulp has essentially been eliminated in some locations around the world. However, one of the alternatives to these wood pulps is *Acacia* wood, but due to lipophilic components, including waxy components, being present in the wood fiber/pulp, the use of *Acacia* wood pulp for papermaking products has been undesirable. When the pulp and fiber being used to make paper or tissue products contains large amounts of *Acacia* wood pulp, such as greater than 30% by weight, the lipophilic components can greatly affect machine runability. Some evidence shows that machine runability is lowered with the addition of *Acacia* wood pulp in the stock and, amounts greater than 35% by weight with respect to the pulp components present, are considered difficult, if not impossible, due to the effects of the lipophilic components on the papermaking components of the papermaking mill. Thus, there is a need to provide a way to use *Acacia* wood pulp and fiber and avoid the disadvantages of working with this wood pulp and fiber, including the detrimental effects of the lipophilic components.

The presence of these lipophilic components can lead to many problems in papermaking. For instance, the lipophilic components, when present, make the pulp fiber difficult to stick to a Yankee dryer for creeping purposes. Also, the presence of these components can cause problems in finishing and converting. Further, as mentioned above, the presence of these components can affect all aspects of the papermaking process by affecting the machine surfaces, fabrics, wires, felts, rolls, and the like.

Accordingly, there is a desire to develop processes which will enable one to use *Acacia* wood pulp and fiber in papermaking.

SUMMARY OF THE INVENTION

A feature of the present invention is to provide methods to control lipophilic components present in fibers that contain the same.

Additional features and advantages of the present invention will be set forth in part in the description which follows, and in part will be apparent from the description, or may be learned by practice of the present invention. The objectives and other advantages of the present invention will be realized and obtained by means of the elements and combinations particularly pointed out in the written description and appended claims.

To achieve these and other advantages and in accordance with the purposes of the present invention, as embodied and broadly described herein, the present invention relates to a method to control lipophilic components present in *Acacia* fibers (especially virgin *Acacia* fibers) containing lipophilic components. The method involves contacting the *Acacia* fiber with a composition comprising at least one enzyme, such as at least one esterase or lipase or both for a sufficient time and in a sufficient amount to control the lipophilic components present in the *Acacia* fiber. The enzyme (e.g., esterase- or lipase-containing compositions) can be introduced at any point in the processing of the *Acacia* fiber containing lipophilic components.

The present invention also relates to stock compositions and paper and tissue and other products containing high amounts of *Acacia* cellulosic fiber.

It is to be understood that both the foregoing general description and the following detailed description are exemplary and explanatory only and are only intended to provide a further explanation of the present invention, as claimed. The accompanying drawings, which are incorporated in and constitute a part of this application, illustrate several embodiments of the present invention and together with the written description, serve to explain the principles of the present invention.

BRIEF DESCRIPTION OF TIME DRAWINGS

Figure 1B:
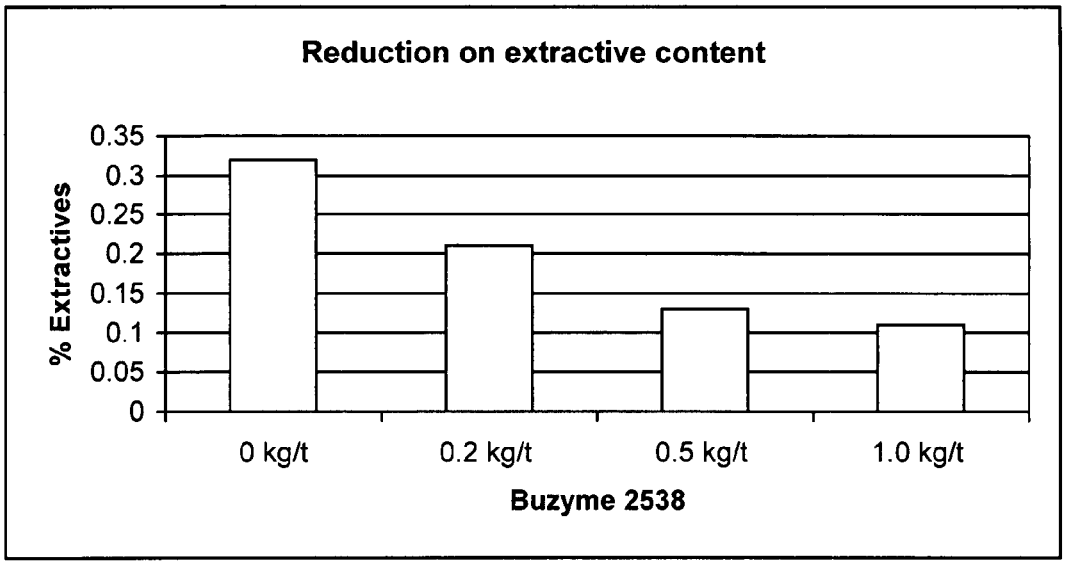

FIGS. 1(*a*) and (*b*) are bar graphs depicting the reduction in lipophilic components and/or using enzymes in *Acacia* pulp fiber.

DETAILED DESCRIPTION OF THE PRESENT INVENTION

The present invention relates to methods to control lipophilic components present in *Acacia* fiber. Preferably, the *Acacia* pulp fiber is partly or completely virgin pulp fiber. The *Acacia* pulp fiber can be used alone in a papermaking process or be combined with other pulp fibers. In the present invention, methods to control lipophilic components can be used where at least a portion of the pulp fiber being treated contains *Acacia* pulp fibers and, more preferably, virgin *Acacia* pulp fibers. For instance, the pulp fiber being treated by the present invention can be 100 wt % *Acacia* pulp fibers, such as 100 wt % virgin *Acacia* pulp fibers, or can be less than 100 wt % *Acacia* pulp fibers, such as from about 1 wt % to about 99 wt %, from about 10 wt % to about 90 wt %, from about 25 wt % to about 75 wt %, from about 50 wt % to about 75 wt % with respect to total weight percent. Any other pulp fiber can be present with the *Acacia* pulp fiber. For instance, *Eucalyptus* pulp fiber, mixed hardwood fiber, Aspen pulp fibers, and/or Birch pulp fibers, and the like can be present. The *Acacia* fiber is typically cellulose fibers and can be *Acacia* fibers from Asia, Indonesia, Africa, and other tropical climates. These types of *Acacia* fibers typically contain large amounts of lipophilic components, which can be quite detrimental to paper products being formed and/or to paper mill machine components, such as fabrics, wires, felts, rolls, Yankee dryers, and any other surfaces found in paper mills that *Acacia* fibers and/or pulp contact during the papermaking or tissue making process. For purposes of the present application, "papermaking" includes all forms of pulp-based products, including tissue, toilet paper, paper towels, napkins, paperboard, paper, and the like. As stated above, the presence of lipophilic components (such as triglycerides and wax) in the pulp fiber can also be a severe detriment to having the pressed fiber stick to a Yankee dryer for purposes of creeping. When these types of fibers or pulp are harvested, these lipophilic components are present along with the fibers obtained during the pulping stage of a papermaking process. These lipophilic components, if not substantially converted and/or removed, can severely interfere with subsequent stages in the papermaking process by effecting the quality of the resulting sheets of paper formed and/or effecting the machinery used to form the paper. Accordingly, the partial or complete removal or conversion of the lipophilic components is important to the papermaking process when such lipophilic components are present in *Acacia* fibers.

For purposes of the present invention, examples of lipophilic components (or extractives) include waxes, fatty acids, alkanols (e.g., white wax and/or long-chained OH compounds, such as $C_{24}$-$C_{28}$—OH, and/or high melting point alkanols of 90° C. or greater), hydroxy extractives, fatty alcohols, triglycerides, dyglycerides, sterols, steryl esters, phospholipids, and the like. Examples of fatty acids include fatty acids with an alkyl group of $C_4$-$C_{30}$, such as $C_{16}$-$C_{18}$ fatty acids, $C_{18}$-$C_{28}$ fatty acids, and/or $C_{20}$-$C_{26}$ fatty acids. The fatty acid can be saturated or unsaturated. A portion or all of the fatty acids can be bound or attached to other molecules, such as triglycerides or phospholipids. Other examples include tetradecanoic (myristic, $C_{14}$); hexadecanoic (palmitic, $C_{16}$); 9,12-octadecadienoic (linoleic, $C_{18}$); 7-octadecadienoic ($C_{18}$); heptadecanoic (margaric, $C_{17}$) or octadecanoic (stearic, $C_{18}$); docosanoic (behinic, $C_{22}$); tetracosanoic (lignoceric, $C_{24}$); hexacosanoic (cerotic, $C_{26}$); and/or pentadecanoic ($C_{25}$). Another way to consider this extractive content is as a) the total unsaponifiable content (e.g., content of alkanols and sterols, and steryl esters) and b) the total fatty acids content. Saturated long-chain fatty acids can be quite difficult to handle in papermaking operations because the saturated long-chain fatty acids cannot be degraded in cooking and/or bleaching steps. Furthermore, compared to unsaturated long-chain fatty acids, saturated long-chain fatty acids are far more difficult to be removed in washing stages during a papermaking process.

These lipophilic components can be present in the *Acacia* pulp or fiber in an amount of at least 0.02 wt %, such as from 0.02 wt % to 2 wt % or more, based on the weight of the pulp or fiber. For purposes of the present invention, the term "lipophilic components" has been used, but it is to be understood that the lipophilic extractives or components can be present in any manner and, therefore, can be considered an impurity, and/or a natural compound(s) found in the pulp or pulp fiber. The term "deposit," "component," or "extractive" is meant to cover the presence of the lipophilic component(s) in or amongst the pulp or pulp fiber, or slurry thereof or web thereof. "Extractive" also refers to the ability of the lipophilic components to be extracted from the pulp as shown in the Examples, e.g., using a solvent like dichloromethane.

In the process of the present invention, these lipophilic components are controlled by contacting the *Acacia* fiber containing the lipophilic components with a composition containing at least one enzyme, such as at least one esterase or lipase or both, for a sufficient time and in a sufficient amount to control the lipophilic extractives present in the *Acacia* fiber. The compositions of the present invention preferably disperse or convert the lipophilic components to organic species that do not affect the paper making process or can be removed or can be dispersed or can be left in the pulp without detrimental effects. For instance, the triglycerides and sterols can be dispersed and/or converted to free fatty acids, which have a lesser effect in the papermaking process and are more easy to manage. These free fatty acids can be more easily treated. For instance, the free fatty acid or other converted organic species can be treated with at least one polymer, alum, and/or aluminum containing species to bind or otherwise attach or trap the free fatty acid or organic species into the pulp and/or paper and, therefore not affect the paper- or tissue-making process or machinery. Or, for instance, the free fatty acids and/or other organic species can be removed in one or more washing steps and, optionally, with the use of one or more dispersants.

The composition containing at least one esterase or lipase or both preferably contains a high concentration of esterase and/or lipase. The lipase can be derived or isolated from pancreatic sources (e.g., pancreatic lipase) or from various fungi and/or bacteria, and/or other microorganisms. Examples include, but are not limited to, triacylglycerol acylhydrolase, and triacyl glycerol lipase. Also, any lipase or esterase capable of hydrolyzing triglycerides to glycerol and fatty acids can be used. Commercially available products containing esterase or lipase can be used. For instance, Buzyme™ 2515, Buzyme™ 2538 and Buzyme™ 2517 products can be used which are products available from Buckman Laboratories International, Inc. Products containing such enzymes as Resinase A2X, Novocor ADL, Pancreatic Lipase 250, Lipase G-1000, Greasex 50L, and Greasex 100L products can be used in the methods of the present invention. Such products are available from such commercial sources as Genencor and Novo Nordisk. The esterase or lipase described in U.S. Pat. Nos. 5,507,952 and 5,356,800 can be used in the present invention and these patents are incorporated in their entirety along with any other patent publications mentioned in this application, by reference herein. The enzyme or lipase can generally be used in any form, such as liquid form or solid form. Preferably, the amount of enzyme, such as an esterase or lipase, used in the methods of the present invention are a sufficient amount to control the lipophilic components present in the fiber. Preferred amounts of the enzyme(s), e.g., esterase and/or lipase, are from about 0.005 lbs. to about 4.0 lbs. per ton of dry fiber, such as from about 0.01 to about 2.5, or from about 0.05 to about 1.0 per ton of dry *Acacia* fiber treated.

The esterase and lipase compositions are preferably stabilized compositions using the formulations described in U.S. Pat. Nos. 5,356,800 and 5,780,283, incorporated in their entirety by reference herein. In the methods of the present invention, at least one polymer, alum, and/or alum containing species can be also added to the fiber containing the lipophilic components. At least one polymer, alum, and/or alum containing species can be added together with the composition containing at least one enzyme, such as at least one esterase or lipase, or at about the same time. Alternatively or additionally, one or more polymers, alum, and/or alum containing species can be added before or after the introduction of the enzyme, such as the esterase and/or lipase. For instance, the polymer(s), alum, and/or alum containing species can be added one hour or less before or after introduction of the enzyme, e.g., esterase and/or lipase, to the fiber. Preferably, the polymer is a water soluble polymer and is more preferably a cationic water soluble polymer. Examples of such polymers include, but are not limited to, epichlorohydrin/dimethylamine polymers (EPI-DMA) and cross-linked solutions thereof, polydiallyl dimethyl ammonium chloride (DADMAC), DADMAC/acrylamide copolymers, ionene polymers, and the like. Examples of ionene polymers include, but are not limited to, those set forth in U.S. Pat. Nos. 5,681,862 and 5,575,993 both incorporated in their entireties by reference herein. Further, the polymers set forth in U.S. Pat. No. 5,256,252 can be used as well and this patent is incorporated in its entirety by reference herein. The polymer, alum, and/or alum containing species, if used in the methods of the present invention, can be used in any amount and preferably in dosage ranges of from about 0.1 to about 15 pounds per ton of dry fiber treated, more preferably from about 0.25 pounds to about 10 pounds per ton of dry fiber treated, and more preferably from about 1 pound to about 5 pounds per ton of dry fiber treated.

For purposes of the present invention, controlling lipophilic components present in *Acacia* fibers can include one or more of the following: reducing the amount of lipophilic extractives that can be extracted by a dichloromethane test as shown in the Examples, reducing the amount of triglycerides or sterols particles, reducing the number or amount of measurable lipophilic material present, and/or reducing the tackiness of the lipophilic components. Preferably, when controlling lipophilic components using the methods of the present invention, all of these reductions occur. Preferably, the reduction of the amount of lipophilic components is at least about 5%, more preferably from about 10% to about 75% as compared to when no esterase or lipase is present. Similarly, the reduction in the number or amount of lipophilic components present in the fiber is reduced by at least about 5%, and more preferably from about 10% to about 75% when compared to fibers which have not been treated with esterase or lipase. Also, the reduction of tackiness of the lipophilic components is preferably reduced by at least about 5%, and more preferably by from about 10% to about 75% when compared to fibers which have not been treated with esterase or lipase.

The compositions containing at least one enzyme, such as at least one esterase or at least one lipase, or both can also contain as an option other conventional paper treatment chemicals or ingredients such as, but not limited to, surfactants, microparticles, solvents, suspension aids, fillers, chelants, preservatives, buffers, water, stabilizers, and the like. These additional ingredients can be present in conventional amounts.

Generally, the composition containing at least one enzyme, such as at least one esterase, at least one lipase, or both, is introduced or brought into contact with the *Acacia* fiber containing the lipophilic components in any fashion. For instance, the esterase- or lipase-containing compositions can be introduced prior to the pulping stage, during the pulping stage, or after the pulping stage. If the enzyme, e.g., esterase- or lipase-containing compositions, are introduced prior to the pulping stage, typically, the composition will be introduced such as by spraying or other means, onto the paper containing product which are going to be introduced into the pulper. Also, or alternatively, the enzyme, e.g., the esterase- or lipase-containing compositions, can be present or introduced into the pulper during the pulping stage which can be by any conventional pulping technique such as mechanical pulping, full chemical pulping, or combinations thereof. The enzyme, e.g., esterase- or lipase-containing compositions, can be introduced during the stock preparation stage of the papermaking process.

The present invention can also be used in manufacturing a creped fiber web, which can use a rotating cylindrical dryer surface. The fiber web can be treated with the composition of the present invention prior to contacting the cylindrical dryer surface, during the time or portion thereof that the fiber web is present on the cylindrical dryer surface, and/or afterwards. In addition or as an alternative, the rotating cylindrical dryer surface can be treated with the enzyme, e.g., esterase- or lipase-containing compositions, of the present invention prior to and/or during the time (and/or afterwards) that the fiber web is in contact with the cylindrical dryer surface or other dryer surface. The devices, steps, and the like described in, for instance, U.S. Pat. No. 6,991,707 can be used in this creeping process, and this patent is incorporated in its entirety by reference herein. Any manner in which to apply the enzyme, e.g., esterase- or lipase-containing composition, onto the fiber web or the dryer surface, such as a Yankee dryer, can be used, such as spraying, coating, dipping, and the like. Essentially, any means to apply a liquid onto a surface like a dryer surface, such as a cylindrical dryer surface and/or to a fiber web, can be used to apply the enzyme, e.g., esterase- or lipase-containing composition, of the present invention to the surface to be treated.

Preferably, the contact time of the enzyme, e.g., esterase- or lipase-containing composition, with the *Acacia* fibers should be maximized. Preferably, the contact time should be sufficient to control the lipophilic components present with the *Acacia* fibers, such that the lipophilic components are substantially controlled. Preferably, the contact time is from about 30 seconds to about 8 hours, more preferably from about 15 min. to about 4 hours, and most preferably from about 30 min. to about 2 hours. Other contact times can be used.

The enzyme, e.g., esterase- or lipase-containing compositions, can be introduced or brought into contact with the *Acacia* fiber at the thick stock storage stage or prior to any flotation stage. Preferably, the enzyme, e.g., esterase- or lipase-containing compositions, are introduced after the flotation stage in the papermaking process. More preferably, the enzyme, e.g., esterase- or lipase-containing compositions, are introduced after the flotation stage and before the paper machine headbox. The compositions can be added in the paper machine white water. In some papermaking processes, there is no flotation step. Thus, the enzyme, e.g., esterase- or lipase-containing compositions, are preferably added at and/or after the pulper, and/or at and/or before the headbox. The compositions can also be added in the paper machine white water.

The manner in which the enzyme, e.g., the esterase- or lipase-containing composition, is introduced or brought into contact with the *Acacia* fiber containing the lipophilic components can be in any fashion, such as by injection points, pouring the enzyme containing compositions into the area to be treated, and/or using repulpable bags of dry or liquid enzymes. The introduction of the enzyme can be immediate, slow release, timed release, intermittent, and/or continuous.

In the methods of the present invention, the enzyme, e.g., esterase- or lipase-containing compositions, can be introduced at multiple points or at just one point of the papermaking operation. In addition, more than one type of enzyme, e.g., esterase- or lipase-containing compositions, can be used, mixtures can be used, or any other variations as long as at least one enzyme, e.g., esterase or lipase, is introduced in some fashion in order to control lipophilic components present in *Acacia* fibers.

In the methods of the present invention, the controlling of the lipophilic components in *Acacia* fibers can be incorporated into any papermaking operation. Typically, the remaining aspects of the papermaking operation as is known to those skilled in the art can be used in order to form paper products. Thus, the conventional additive materials used with papermaking pulps during stock preparation can be used as well in the present invention. Continuous or non-continuous papermaking machines can then convert aqueous suspensions of fibers and other ingredients into dry sheets of paper using such conventionally known operations which involve Fourdrinier machines or cylinder machines or other papermaking devices. Subsequent treatments of the sheets of paper to achieve the desired characteristics such as machine calendering and/or coating of the papersheets and the like can also be used in the present invention.

As part of the present invention, the present invention relates to stock compositions containing at least 35 wt % or more *Acacia* pulp, wherein the percent is by weight of total fiber content that is generally by weight of dried fiber content. In other embodiments, the stock composition can contain 40 wt % to 100 wt %, or 45 wt % to 80 wt %, or 60 wt % to 75 wt % *Acacia* wood pulp where, again, the percent by weight is based on the total pulp weight percent content. In one embodiment, the stock composition can contain *Acacia* wood pulp in the weight percent range provided above and include other pulp fibers, such as NBKP (needle bleached Kraft pulp) and/or mixed hardwood, and/or *Eucalyptus*, and/or MTHW, etc., in an amount of about 1 wt % to about 65 wt %, such as from about 5 wt % to about 25 wt % or from about 15 wt % to about 20 wt % by weight based on the total weight of fiber content present. The stock composition can be for any wood pulp-containing product, such as paper, facial products, toilet paper, paper towels, napkins, tissue paper, and the like. Accordingly, the present invention, in one or more embodiments, relates to wood fiber-containing products, such as paper, paperboard, facial products, tissues, paper towels, napkins, toilet paper, and the like, which contains *Acacia* pulp fibers in the amounts provided above.

In one or more embodiments of the present invention, the present invention relates to stock compositions, wherein the *Acacia* fibers are present in an amount of at least 35% by weight of the overall fiber composition, and can be from 40 wt % to 100 wt %. Similarly, the present invention relates to paper, tissue, paper towels, napkins, or other paper or paperboard products comprising at least 35 wt % of *Acacia* fiber, wherein this amount is based on the total weight percent of fibers present. This amount can be from about 40 wt % to 100 wt %. The present invention farther relates to paper, tissue, paper towels, napkins, or other paper or paperboard products, or stock compositions further comprising at least one free fatty acid in any amount, such as from about 0.01 wt % to about 0.75 wt %, or from about 0.1 wt % to about 0.5 wt % (or more), based on the weight of the paper, tissue, paper towels, napkins, or other paper or paperboard products, or stock composition. In one or more embodiments, the present invention relates to a stock composition or a paper, tissue, paper towels, napkins, or other paper or paperboard products having a lipophilic extractive amount of less than 0.60 wt %, or less than 0.45 wt %, or having an extractive content range of from about 0.1 wt % to about 0.5 wt %, wherein this weight percent is based on extractive content calculated on a dry weight basis, as shown in the Examples. In one or more embodiments, the present invention relates to a stock composition, or a paper, tissue, paper towels, napkins, or other paper or paperboard products further comprising at least one enzyme, such as at least one esterase or lipase. In one or more embodiments of the present invention, the present invention can further comprise at least one dispersant, polymer, alum, and/or alum containing species present in the stock composition, paper, tissue, paper towels, napkins, or other paper or paperboard products.

Prior to the present invention, the high extractive content in *Acacia* pulp caused the tissue sheet to float in the Yankee dryer, which eventually lowers the machine speed and reduces machine runability. Thus, in the past, the use of *Acacia* fibers was undesirable and discouraged, and if amounts were used, amounts significantly below 30% by weight in the stock composition were used. In the present invention, the process has provided the ability to formulate stock compositions containing significantly higher amounts of *Acacia* fibers in the making of pulp products, such as paper, tissue, toilet paper, and the like, and by reducing or controlling the extractive levels, can help to reduce sheet floating that occurs. This permits an increase in machine speed and runability of the Yankee dryer and other devices and surfaces in papermaking processes.

The present invention will be further clarified by the following examples, which are intended to be purely exemplary of the present invention.

EXAMPLES

Example 1

In each of the following examples, a machine chest stock of virgin *Acacia* fibers was obtained from a mill and had approximately 3 to about 5% by weight consistency of fibers or solids. This stock was then diluted to a 1% by weight consistency and heated to approximately 50 to 60° C. 1,000 milliliter samples of the dilute stock were then placed on a hot plate to maintain the 50 to 60° C. temperature and the dilute stock was mixed at a constant rate of approximately 100-150 rpm. Then, 0.05 to about 0.5 lbs. of enzyme per ton of dry fiber was added to the furnish and the samples were mixed for 1 to 2 hours.

The samples were then diluted to 10 liters by introducing water and then these samples were screened through a Pulmac Masterscreen using a 0.004 inch screen. The contaminants collected on the filter pad were dried in an oven. A clean piece of filter paper was placed on top of the collection pad and both pieces were then placed on a Carver Press and pressed for 3 minutes at 300° F. (135° C.) at a pressure of 10,000 psi. The top filter was then peeled off and the amount of contaminants by ppm were measured using an Optimax Flatbed Scanner. The amount of lipophilic contaminants was thus measured using an image analyzer which is similar to a flatbed scanner. In these examples, Resinase A 2x, formulated into Buzyme™ 2517 was used. 0, 0.2 kg/ton, 0.5 kg/ton, and 1.0 kg/ton of Buzyme™ 2517 was used for virgin *Acacia* pulp. Each amount is based upon the per ton weight of the dry *Acacia* fiber treated. Also, Buzyme™ 2538 was used in additional experiments in the same manner.

The results are set forth below are compared to a Control ("Blank"), wherein the same procedure as described above was followed except no enzyme was added to the finish. As can be seen, the amount of the lipophilic components was significantly reduced when the esterase- or lipase-containing composition was used. In fact, in most instances, the method of the present invention reduced the amount of lipophilic contaminants by at least 30% by weight, and in some instances reduced the amount of lipophilic contaminants by 50% or more than 80% by weight. Thus, the present invention was quite effective in reducing the amount of lipophilic contaminants in fibers.

Extractive Content Analysis

Dichloromethane Quantitative Extraction

Sample A was treated with Buzyme™ 2517 (pH: 5.5, Temp: 50° C., Retention time: 1 hour)

| Sample I.D.: | *Extractive Content (wt %) |
|---|---|
| Blank: | 0.13 |
| 0.2 kg/t | 0.086 |
| 0.5 kg/t | 0.024 |
| 1.0 kg/t | 0.022 |

*calculated on dry weight basis

Sample B was treated with Buzyme™ 2517 (pH: 5.5, Temp: 50° C., Retention time: 1 hour)

| Sample I.D.: | *Extractive Content (wt %) |
|---|---|
| Blank: | 0.32 |
| 0.2 kg/t | 0.21 |
| 0.5 kg/t | 0.13 |
| 1.0 kg/t | 0.11 |

*calculated on dry weight basis

Sample B was treated with Buzyme™ 2538 (pH: 5.5, Temp: 75° C., Retention time: 1 hour)

| Sample I.D.: | *Extractive Content (wt %) |
|---|---|
| Blank | 0.13 |
| 0.2 kg/t | 0.13 |
| 0.5 kg/t | 0.12 |
| 1.0 kg/t | 0.088 |

*calculated on dry weight basis

FIGS. 1(*a*) and (*b*) are bar graphs depicting these results.

Sample C was treated with Buzyme™ 2538 (pH: 5.0, Temp: 45° C., Retention time: 1 hour)

| Sample I.D.: | *Extractive Content (wt %) |
|---|---|
| Blank: | 0.44 |
| 0.2 kg/t | 0.37 |
| 0.5 kg/t | 0.15 |
| 1.0 kg/t | 0.12 |

*calculated on dry weight basis

Example 2

In this example, a trial was conducted at a papermaking plant, wherein Buzyme™ 2538 product was used in the stock composition and the stock composition of *Eucalyptus* was replaced entirely over time with *Acacia* wood pulp. During this time, various conditions of the Yankee dryer, as well as the sheet quality were observed. With the use of Buzyme™ 2538 product at a dosage rate of 1 kg per ton of *Acacia* pulp fiber present, the Yankee dryer was able to maintain machine speed runability and the tissue quality was maintained as well. Further, there were no noticeable finishing problems.

As firer detailed, the machine speed of the Yankee dryer was maintained at approximately 1700 mpm (meters per minute) and, at times, exceeded 1800 mpm even when the *Eucalyptus* fiber was totally replaced with *Acacia* wood fiber and the total amount of *Acacia* wood fiber was about 80 wt % and the remaining 20% was NBKP.

Furthermore, the sheet quality during this time (when *Acacia* was slowly and then entirely replacing *Eucalyptus* wood fiber) was also acceptable, wherein the softness was within acceptable ranges, and the thickness was within acceptable limits, such as from about 110 microns to about 130 microns.

In addition, during this trial, the extractive content was measured to determine if the extractive content with regard to lipophilic components was properly controlled as the amount of *Acacia* wood fiber increased and replaced the *Eucalyptus* content. During this time, even when the *Acacia* wood fiber totally replaced the *Eucalyptus* content, the extractive content as measured at the blend chest and head box remained substantially the same, even as the amount of *Acacia* wood pulp fiber greatly increased. As an example, the extractive content of the wood pulp when it contained 80 wt % *Acacia* and 0% *Eucalyptus* was 0.59% at the blend chest and 0.40% at the head box, whereas when the *Eucalyptus* content and *Acacia* content was at a weight ratio of 3:5, the extractive content at the blend chest was 0.42% and 0.27% at the head box. The extractive content was determined as an example 1 using a dichloromethane quantitative extraction. A listing of the various sample testing taken as the ratio of *Acacia* increased is shown below in the table.

Organic Analysis

Dichloromethane Quantitative Extraction

| Weight ratio | |
|---|---|
| Sample I.D.: | A1: E:A = 5:3 – Blank - BC |
| * Extractive Content: 0.61% | |
| Sample I.D.: | A2: E:A = 5:3 – Blank - HB |
| * Extractive Content: 0.39% | |
| Sample I.D.: | B1: E:A = 5:3 + enzyme - BC |
| * Extractive Content: 0.65% | |
| Sample I.D.: | B2: E:A = 5:3 + enzyme - HB |
| * Extractive Content: 0.17% | |
| Sample I.D.: | C1: E:A = 4:4 + enzyme - BC |
| * Extractive Content: 0.68% | |
| Sample I.D.: | C2: E:A = 4:4 + enzyme - HB |
| * Extractive Content: 0.23% | |
| Sample I.D.: | D1: E:A = 3:5 + enzyme - BC |
| * Extractive Content: 0.42% | |
| Sample I.D.: | D2: E:A = 3:5 + enzyme - HB |
| * Extractive Content: 0.27% | |
| Sample I.D.: | E1: E:A = 2:6 + enzyme - BC |
| * Extractive Content: 0.76% | |
| Sample I.D.: | E2: E:A = 2:6 + enzyme - HB |
| * Extractive Content: 0.61% | |
| Sample I.D.: | F1: E:A = 1:7 + enzyme - BC |
| * Extractive Content: 0.55% | |
| Sample I.D.: | F2: E:A = 1:7 + enzyme - HB |
| * Extractive Content: 0.45% | |
| Sample I.D.: | G1: E:A = 0:8 + enzyme - BC |
| * Extractive Content: 0.59% | |
| Sample I.D.: | G2: E:A = 0:8 + enzyme - HB |
| * Extractive Content: 0.40% | |

* Calculated on dry weight basis
BC: Blend Chest
E: Eucalyptus pulp
HB: Head Box
A: Acacia pulp Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A method to control lipophilic components present in virgin *Acacia* fibers containing lipophilic components comprising contacting said virgin *Acacia* fibers present in the form of a fiber web with a composition comprising at least one esterase or lipase or both, for a sufficient time and in a sufficient amount to control the lipophilic components present in the virgin *Acacia* fibers, and creping said fiber web to form a creped fiber web, wherein said contacting is prior to, during, or after said creping.

2. The method of claim 1, wherein the lipophilic components are at least controlled by reducing the amount of lipophilic components present in the virgin *Acacia* fiber.

3. The method of claim 1, wherein the lipophilic components are at least controlled by reducing the size of the lipophilic components present in the virgin *Acacia* fibers.

4. The method of claim 1, wherein said composition is further introduced prior to or during a pulping stage, prior to said creping.

5. The method of claim 1, wherein said composition is further introduced during or right before a stock preparation stage, prior to said creping.

6. The method of claim 1, wherein said composition is further introduced after a flotation stage, prior to said creping.

7. The method of claim 1, wherein said composition is introduced in an amount of from about 0.005 to about 4.0 lbs. per ton based on dry *Acacia* fiber.

8. The method of claim 1, wherein said composition is in contact with the virgin *Acacia* fibers for a time of from about 30 seconds to about 8 hours.

9. The method of claim 1, further comprising contacting said virgin *Acacia* fibers with a composition comprising at least one polymer, alum or any other aluminum species.

10. The method of claim 9, wherein said at least one polymer is a water soluble cationic polymer.

11. The method of claim 9, wherein said polymer is introduced at about the same time as said esterase or lipase.

12. The method of claim 9, wherein said polymer is introduced after introducing said esterase or lipase.

13. The method of claim 9, wherein said polymer is introduced before introducing said esterase or lipase.

14. The method of claim 1, wherein said composition further comprises at least one polymer.

15. The method of claim 14, wherein said at least one polymer is a water-soluble cationic polymer.

16. The method of claim 1, wherein said composition is further introduced prior to the paper machine headbox, prior to said creping.

17. The method of claim 1, wherein said composition is further introduced in the paper machine white water, prior to said creping.

18. The method of claim 1, wherein said creping utilizes a rotating cylindrical dryer surface.

* * * * *